US008322587B2

(12) United States Patent
Granger et al.

(10) Patent No.: US 8,322,587 B2
(45) Date of Patent: Dec. 4, 2012

(54) ROLLER ASSEMBLY FOR WEB MATERIAL DISPENSER

(75) Inventors: Maurice Granger, Saint-Priest-en-Pagnol (FR); Per Moeller, Leksand (SE); Erik Hjort, Saeter (SE)

(73) Assignee: Maurice Granger, Saint-Priest-en-Jarez (FR)

( * ) Notice: Subject to any disclaimer, the term of this patent is extended or adjusted under 35 U.S.C. 154(b) by 824 days.

(21) Appl. No.: 12/520,556

(22) PCT Filed: Dec. 21, 2007

(86) PCT No.: PCT/IB2007/004069

§ 371 (c)(1), (2), (4) Date: Jul. 2, 2009

(87) PCT Pub. No.: WO2008/078168

PCT Pub. Date: Jul. 3, 2008

(65) Prior Publication Data

US 2010/0025519 A1 Feb. 4, 2010

(30) Foreign Application Priority Data

Dec. 22, 2006 (FR) ..... 06 55855

(51) Int. Cl.
*B26F 3/02* (2006.01)
*B65H 20/02* (2006.01)

(52) U.S. Cl. ..... 225/72; 226/96; 83/649

(58) Field of Classification Search ..... 83/649, 83/334, 436.3; 225/10, 16, 34, 39, 43, 55, 225/72; 226/93, 96; 193/1
See application file for complete search history.

(56) References Cited

U.S. PATENT DOCUMENTS 2,099,473 A * 11/1937 Findlater ..... 193/1
2,839,345 A * 6/1958 Engel et al. ..... 225/16
4,213,363 A * 7/1980 Granger ..... 83/298
4,978,415 A * 12/1990 Jones ..... 156/517
5,042,351 A * 8/1991 Rosenthal ..... 83/649

(Continued)

FOREIGN PATENT DOCUMENTS

FR 2701016 A1 8/1994

(Continued)

OTHER PUBLICATIONS

International Search Report for PCT/IB2007/004069 dated Nov. 12, 2008.

*Primary Examiner* — Sean Michalski
(74) *Attorney, Agent, or Firm* — Heslin Rothenberg Farley & Mesiti P.C.

(57) ABSTRACT

A roller assembly in a wipe material dispenser has at least one pair of cooperating rollers arranged to feed the wipe material. The roller assembly comprises a first and a second roller, wherein each roller comprises a central longitudinal core on which is mounted a number of parallel and axially spaced discs. Each roller has regions of reduced diameter between adjacent discs, and the first and the second roller are located so that the axial location of the spaced discs on the first roller coincides with the regions of reduced diameter between adjacent discs on the second roller. A roller suitable for use in the roller assembly and a dispenser including such an assembly are also provided.

23 Claims, 4 Drawing Sheets

U.S. PATENT DOCUMENTS

| | | | | |
|---|---|---|---|---|
| 5,419,003 | A * | 5/1995 | Tollasepp | 15/230.11 |
| 6,314,850 | B1 | 11/2001 | Morand | |
| 6,581,500 | B1 * | 6/2003 | Kietaibl | 83/337 |
| 6,609,450 | B2 * | 8/2003 | Granger | 83/649 |
| 6,659,929 | B1 * | 12/2003 | Jaksch | 493/375 |
| 6,684,751 | B2 * | 2/2004 | Kapiloff et al. | 83/649 |
| 6,962,101 | B2 * | 11/2005 | Granger | 83/337 |
| 7,066,070 | B2 * | 6/2006 | Granger et al. | 83/649 |
| 7,661,344 | B2 * | 2/2010 | Beaudry | 83/76 |
| 8,056,455 | B2 * | 11/2011 | Beaudry | 83/13 |
| 2002/0030075 | A1 * | 3/2002 | Granger | 225/16 |
| 2004/0089127 | A1 * | 5/2004 | Hong | 83/649 |
| 2004/0248716 | A1 * | 12/2004 | Mitchell | 492/13 |
| 2006/0266784 | A1 * | 11/2006 | Kananen | 225/6 |
| 2007/0059018 | A1 * | 3/2007 | Tokuda | 399/90 |
| 2007/0082777 | A1 * | 4/2007 | Nishida et al. | 474/237 |
| 2010/0140372 | A1 * | 6/2010 | Patrick | 239/52 |
| 2011/0229162 | A1 * | 9/2011 | Ogawa et al. | 399/33 |
| 2012/0093551 | A1 * | 4/2012 | Ogawa et al. | 399/333 |

FOREIGN PATENT DOCUMENTS

| | | |
|---|---|---|
| FR | 2723303 A1 | 2/1996 |

* cited by examiner

ROLLER ASSEMBLY FOR WEB MATERIAL DISPENSER

CROSS REFERENCE TO RELATED APPLICATIONS

This application is a national stage filing under section 371 of International Application No. PCT/IB2007/004069 filed on Dec. 21, 2007, and published in French on Jul. 3, 2008 as WO 2008/078168 and claims priority of French application No. 0655855 filed on Dec. 22, 2006, the entire disclosure of these applications being hereby incorporated herein by reference.

TECHNICAL FIELD

The invention relates to the technical field of dispensers used to dispense webs of material having a given format or selected format. In particular, the invention is related to a roller assembly for feeding a web and rollers for use in such assemblies.

BACKGROUND ART

Dispensers used to dispense webs of material are widely used and have numerous uses for hand wipes, toilet paper and other wipes. In order to make the object of the invention readily understandable, FIG. 1 shows a general dispensing machine of this type. This machine comprises, in a housing (1), a roller (2) that includes a mechanism for cutting (3) a web of material originating from a reel of material (4). This reel is either hung from support side plate (5) on the housing of the machine in a plane that is perpendicular to the back wall or said reel of material rests on the actual roller itself. The roller has ends that form protruding fingers that rest against and allow centring on the housing's accommodating side plate. To achieve this and in this case, the roller has, over its length and over its peripheral edge, a gripping area that allows the web of material to be held fast in order to facilitate its unwinding. Alternatively and as shown in FIG. 1, a pressure roller (6) presses against the roller. The gap between them leaves clearance for the web of material. The roller has parallel intermediate discs with a notch leaving clearance for the blade-holder. Such an arrangement is described in French Patent No. 2701016.

Depending on the quality of the wipe material, which is generally made of cellulose wadding, and its thickness, which varies depending on the particular market (European or American for example), it is necessary to ensure paper retention under optimum conditions. One proposed solution involves designing the roller with means to ensure retention of the web of material either by using hook-and-loop type strips that are therefore rough or by using sleeves made of an elastomeric material arranged along the roller over all or part of its surface, apart from the area through which the cutting blade moves.

This is described, for example, in the French Patent No. 8319815. The latter also makes provision for designing the roller with a plurality of parallel discs, arranged along the longitudinal axis of the roller, on which the web of material to be cut rests, as shown in French Patent No. 2701016.

The proposed solutions have proved satisfactory in a very large number of industrial applications.

There nevertheless remains the problem of changes in the characteristics of the wipe material and also the durability of the elastomeric sleeves which have a tendency to lose their ability to adhere to the actual roller and no longer retain the web of wipe material.

The invention aims to provide an improved roller for dispensing sheets of wipe materials from a dispenser. The solution according to the invention also aims to provide a roller assembly that makes it possible to reduce the force required to remove a sheet from the dispenser, while preserving the adhesion properties of the roller surfaces with respect to the dispensed material.

DISCLOSURE OF INVENTION

The invention aims to solve the above problems by providing an improved roller assembly and a roller used in such a roller assembly, as defined by the appended claims.

The solution provided by the invention is simple, easy to use and does not require any upgrading of the wipe material dispensing machine that is likely to incur significant die costs or other investments of this kind.

According to a preferred embodiment, the invention relates to a roller assembly in a wipe material dispenser comprising at least one pair of cooperating parallel rollers, which rollers are arranged to feed the wipe material. The roller assembly may comprise at least a first and a second roller, wherein each roller comprises a central longitudinal core on which is mounted a number of parallel and axially spaced discs. The roller may have regions of reduced diameter between adjacent discs and the first and the second roller are preferably located so that the axial location of the spaced discs on the first roller coincides with the regions of reduced diameter between adjacent discs on the second roller. Both rollers may be feeding rollers or one of the rollers may be provided with a cutting device for cutting a wipe material in a space or a nip between the rollers.

According to a first alternative embodiment, the outer surfaces of the first and second rollers may be arranged spaced apart so that there is no contact between the rollers. The distance between the rollers is dependent on the intended use of the roller assembly. For instance, when it is desired to feed a sheet or web of materials through the rollers in a substantially flat state, but with sufficient friction to prevent the web to slip between the rollers, the rollers may be placed so that their outer diameters substantially coincides along the length of the rollers. In this case the distance between tangential planes through the outermost periphery of the first and second roller may be selected to be equal to or less than the thickness of the wipe material to be passed between the rollers. If the said distance is selected to the thickness of the material to be fed, then the contact pressure applied to the material may be reduced to zero, or near zero. The wipe material is then only fed forward by the friction forces between the rollers and the material or web.

According to a second alternative embodiment, the tangential planes through the outermost periphery of the first and second roller are arranged to coincide or to intersect the discs of the respective cooperating roller. When the tangential planes of the rollers coincide, then the wipe material will begin to form an undulating shape in a cross-section taken through the central axes of the first and second rollers. This arrangement will increase the contact pressure between the rollers and the wipe material and may also increase the friction forces between the rollers and the wipe material. If greater friction or force is required for feeding a sheet or web, the distance between the rollers may be reduced further. This may cause the material to be fed to assume the general shape of the outer contour of the cooperating rollers.

The setting of the distance between the rollers is determined by the quality and strength of the material to be fed by the rollers, as well as the allowable or maximum desirable deformation of the material.

In order to accommodate webs or sheets of different thickness, surface texture or strength, the spacing between the rollers may be adjustable. According to one example, the roller assembly comprises a fixed lower roll and a movable upper roll. The movable upper roll may be suspended by a spring suspension.

In use, the above roller or drum is primarily intended for feeding and/or cutting a web in a wipe material dispenser. The roller may comprise a central longitudinal core that corresponds to the length of the roller and protrudes at its ends so that it can be positioned relative to the accommodating side plates of the housing of the dispenser. If used for cutting the material, said roller may be designed with an end disc having an opening for movement of the blade-holder and, opposite this, another notched end disc with an offset shaped accommodating support for the other end of the blade-holder. Between the end discs of the roller, the roller is designed with a plurality of intermediate discs parallel to each other and mounted with a predetermined spacing between adjacent discs. The intermediate discs and one end disc being designed with a notch that defines the area in which the cutting device is housed in order to enable its articulation and swivelling. The roller accommodates one or more sleeves made of an elastomeric material. In its simplest form the roller is configured to accommodate a single sleeve made of an elastomeric material that is tensioned around the disc-shaped components of said roller. In its original state, such a sleeve may have an inner diameter that is marginally smaller than the diameter of the outer diameter of the discs and may have predetermined elastic deformation properties.

A sleeve may comprise one or more means of tensioning the sleeve in order to push a section of the sleeve into the bottom of the various notches and maintain it in this position. When fastened, the fastening means causes elastic deformation of the sleeve, which will grip the outer peripheral edges of the intermediate discs, thereby causing the formation of regions of reduced diameter between adjacent intermediate discs. The sleeve may also be arranged to cover one or both end discs of the roller According to a further preferred embodiment, the invention relates to a roller or a drum in a roller assembly for a wipe material dispenser, which roller comprises a central longitudinal core on which is located a number of parallel and axially spaced discs. The roller is provided with at least one sleeve of a friction material that is arranged around the discs, providing the roller with regions of reduced diameter between adjacent discs. The friction material is selected dependent on the type of wipe material to be dispensed. Examples of suitable friction materials are sandpaper, natural rubber or an elastomer material. According to one example, the at least one sleeve is made of a suitable thermoplastic elastomer material (TPE). Such an elastomer material may be elastically deformable and can be extruded onto or tensioned around one or more of the discs. The invention is not limited to a particular method of applying or coating the outer periphery of the one or more discs.

The invention primarily relates to rollers or drums used in dispensers as described above. In comparison, a drum may be defined as a relatively large diameter roller. In the subsequent text the term "roller" will be used for these types of components.

According to one embodiment the roller may be covered by a sleeve or ring of an elastically deformable material encircling the outer periphery of each individual disc. A cross-section in a radial plane through such a sleeve or ring is preferably, but not necessarily, rounded at least at the outer periphery thereof. The material may be glued, vulcanized or simply stretched around the outer edge of the disc. In cases where the roller comprises a cutter, the elastic ring or sleeve may be tensioned around one or multiple discs by means of a tensioning means located in a groove in the outer periphery of each disc. In this embodiment the roller will have its largest diameter in the position of each disc, while the smallest diameter is determined by the size of the central core between adjacent discs. Alternatively, the smallest diameter may be determined by a relatively smaller diameter of a number of intermediate discs, each located between adjacent larger diameter discs.

According to a further embodiment the roller is covered by an elastically deformable material along its entire width. Depending on the thickness of the sleeve and the amount of tension applied around the discs, the cross-sectional profile in a radial plane through a sleeve, in the longitudinal direction of a roller, may be given a shape varying from substantially sinusoidal to a substantially trapezoidal shape. The roller will have its largest diameter in the position of each disc and a relatively smaller diameter between adjacent discs.

An alternative to the latter embodiment is to provide the roller with two or more elastically deformable sleeves arranged separated along the width of the roller. For instance, when providing a roller with two sleeves of equal length, the sleeves may be separated by a central spacing to allow a drive belt to be mounted in this space.

When combining rollers into a pair of rollers for feeding a web of material, it is also possible to combine rollers of different types. For instance, a roller with discs having individual sleeves or rings of an elastic material may be placed to cooperate with a roller having a sleeve of elastic material extending over the entire or a part of the length of the roller.

In order to allow an extended sleeve of an elastically deformable material to be tensioned around the discs, the roller may be provided with at least one tensioning means for each sleeve. In this case a sleeve having a marginally larger inner diameter than the discs on the roller is slipped onto a roller comprising a core and a predetermined number of spaced discs to be covered. The tensioning means is arranged to cause elastic deformation of the sleeve, which sleeve is arranged to grip the outer edges of the discs and to cause the formation regions of reduced diameter between adjacent discs. According to one example, the tensioning means may comprise at least one extended bar for each sleeve or roller. Hence, a bar or a similar tension means may extend over one or more sleeves, across the entire roller, or across individual sleeves only. The bar may be inserted into radial notches in the outer periphery of the discs, which notches are placed along a generatrix of a cylinder encompassing the discs. The bar may then be fixed to the roller, either by attaching it to the ends of the roller or a section of the roller, or directly onto the discs, Alternatively, the discs may be provided with two or more opposite notches to allow the sleeve to be tensioned by two or more bars or similar attachment means.

The notches provided for the tensioning means may also serve as a mounting for a cutting device for cutting sheets of wipe material, as will be described in further detail below.

Other suitable tensioning means may also be used for achieving the desired effect and shape of a roller. For instance, it is possible to clamp a sleeve at both ends of a roller, or a section of a roller, and arrange tensioning means around the circumference thereof between adjacent discs.

Alternatively a sleeve having suitable elastic and heat responsive characteristics may be placed over the roller and heat treated to shrink the sleeve in order to achieve a desired tension in the sleeve material.

According to a further embodiment, the discs may be located intermediate and parallel to end discs mounted at each end of the roller. This arrangement may be used when the roller is a cutting roller, wherein one end disc and the intermediate discs are provided with a notch in which a cutting device is mounted. A first end of the roller may be provided with an end disc with an opening for an actuator arranged to act on a first end of a blade-holder. A second, opposite end of the roller is provided with notched end disc with a support for a second end of the blade holder.

The discs making up the roller may be separated by a predetermined, constant distance. Alternatively, the discs are separated by a distance that varies across the width of the roller. The distance between adjacent discs may be determined by the expected loading on the roller, or be reduced adjacent an end of a roller or a sleeve.

These aspects and others will become apparent from the following description.

BRIEF DESCRIPTION OF DRAWINGS

The object of the present invention is described, merely by way of example, in the accompanying drawings in which.

EMBODIMENTS OF THE INVENTION

In order that the object of the invention may more readily be understood, the following description is given, merely by way of example, reference being made to the accompanying drawings.

The roller for a wipe material dispensing machine is represented in its entirety by (10). It has a longitudinal central core (10*a*) that corresponds to the length of the roller and protrudes at its ends (10*b*) so that it can be positioned relative to the accommodating side plates of the housing of the machine. In a known manner, this roller has an end disc (10*c*) that has an opening (10*d*) allowing movement of the blade-holder and, at the opposite end, another notched end disc (10*e*) with an offset shaped accommodating support (10*f*) for the other end of the blade-holder. Between the end discs (10*c*-10*e*) of the roller, the latter is designed with a plurality of intermediate discs (10*g*) arranged parallel to each other and spared apart in accordance with a predetermined spacing.

Figure 1:
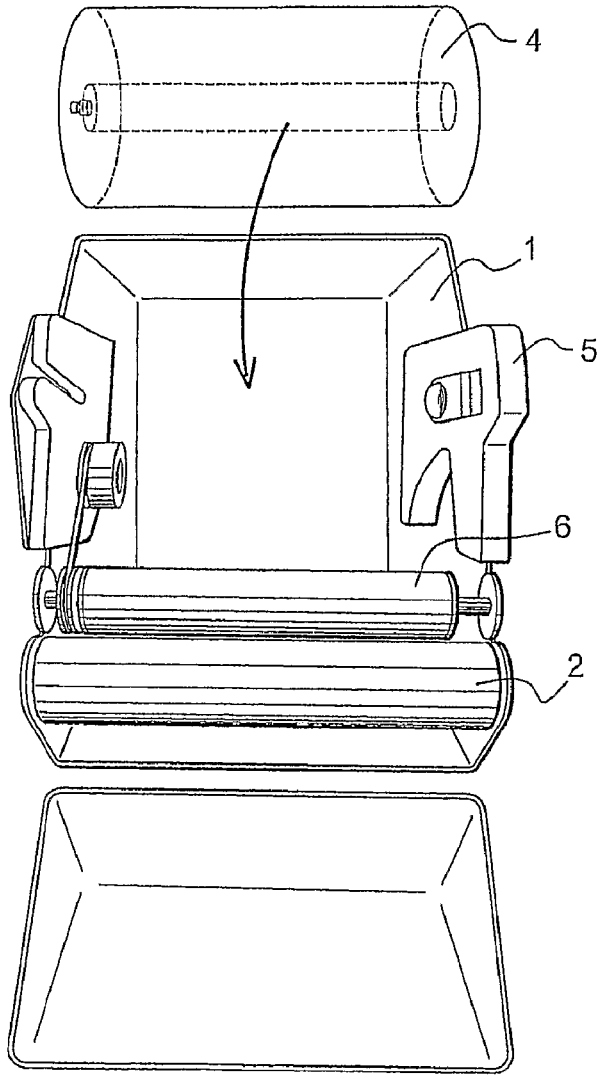
FIG. 1 shows a front view showing a dispensing machine according to the prior art.
Figure 2:
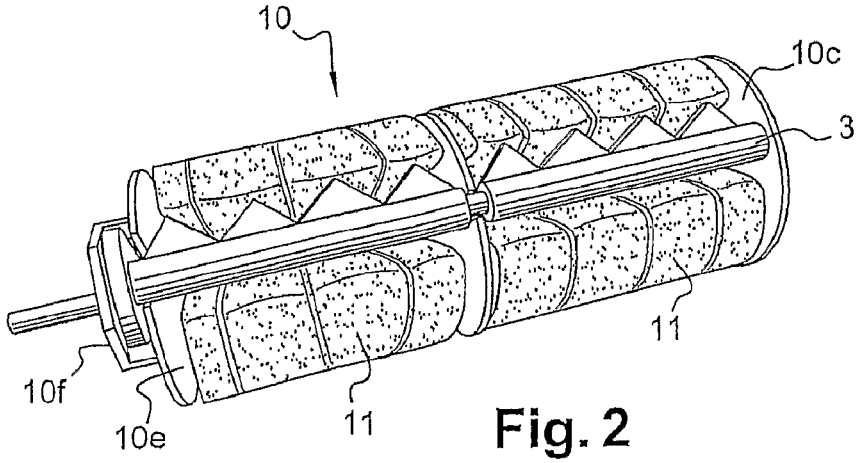
FIG. 2 shows a perspective view of the roller according to the invention.
Figure 3:
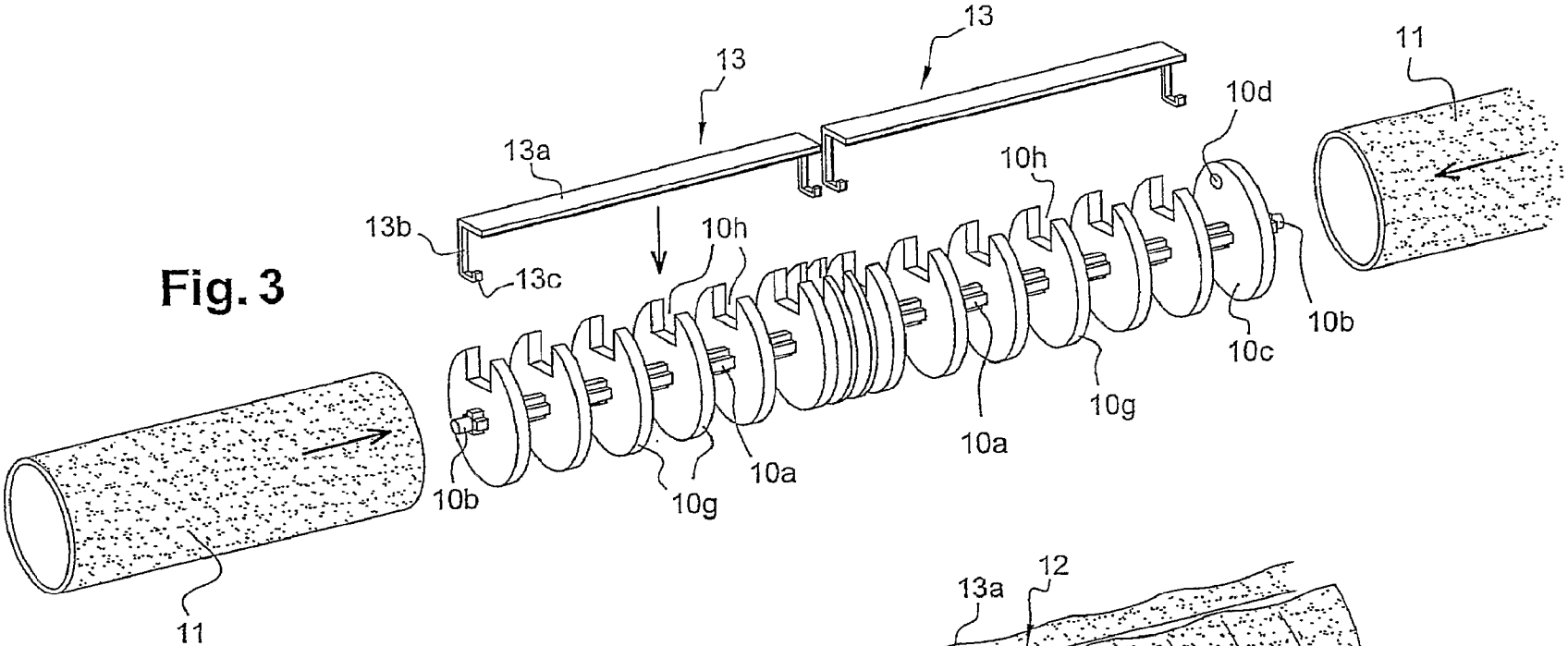
FIG. 3 shows the configuration of the roller in an exploded view before assembly in a first embodiment that uses tensioning of the sleeve(s)—the cutting device is not shown.

According to the invention, the roller is devised to accommodate one or more sleeves (11) made of an elastomeric material, which sleeves are tensioned around the disc-shaped component parts of said roller. In its/their original state, this or these sleeves have a diameter that is substantially in excess of the diameter of the roller and has/have a certain deformation elasticity. The intermediate discs (10*g*) and the end disc (10*e*) of the roller are thus designed with a square shaped notch (10*h*), all of the notches being in alignment as shown in FIG. 3. The notches define the area in which the cutting device is housed (12) and enable articulation and swivelling of the blade in a known manner. The notches also provide for positioning of the means (13) for tensioning the sleeve(s) in order to push and keep it/them at the bottom of the various notches. In order to take into account the length of the roll and also the possible layout of the middle part of the roller to provide a guide flange for a transmission belt linking the roller to a pressure roller, the elastomer sleeve can be made in one or two parts that are positioned over the totality of the roller. One part is used if the latter is not designed with a transmission belt. Two parts can be used over the two halves of the length of the roller as shown in the Figures if there is a transmission belt, or if the roller is relatively long or has a relatively small diameter. In the latter case more than one tensioning means can be required to maintain an even tension on the sleeve along the entire length of the roller. According to the invention, the means (13) of tensioning the part or parts of the sleeves is intended to press up against the upper exposed part of the latter in order to push it/them against the bottom of notch (10*h*). This downward movement therefore causes elastic deformation of the part or parts of the sleeves which then grip the upper edges of the intermediate discs and one end disc of the roller, thereby causing the formation of folds or regions of reduced diameter between consecutive intermediate discs in order to ensure better retention of the material when used as a pressure, feeding or cutting roller.

Figure 4:
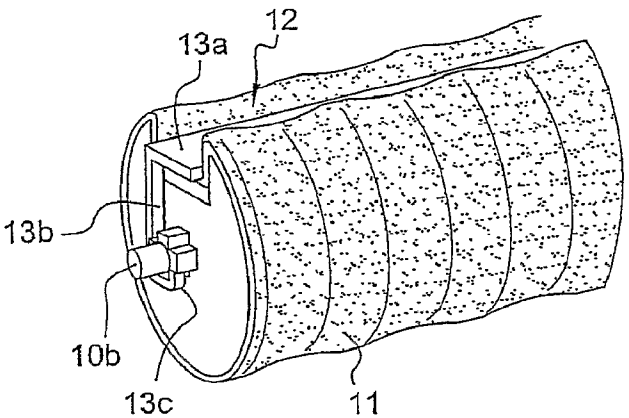
FIG. 4 shows a partial perspective view of the roller alter assembly.
Figure 5:
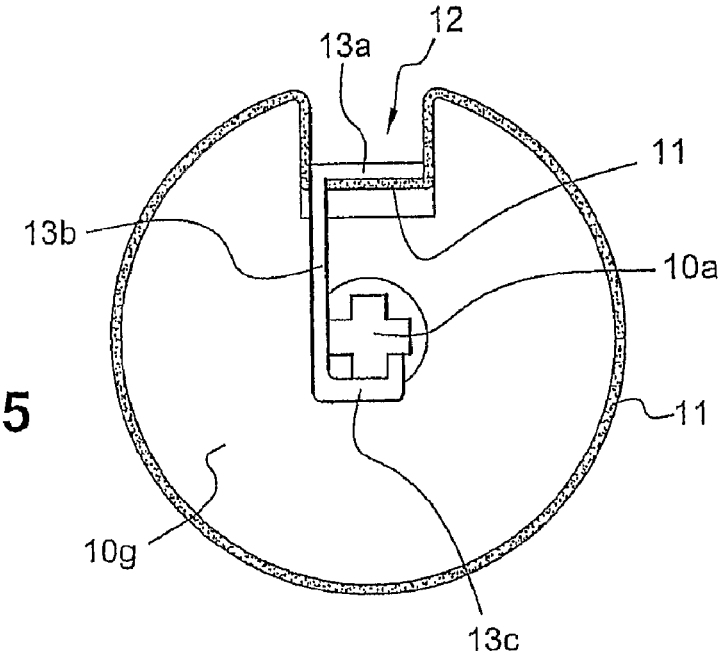
FIG. 5 shows an end-on view of the roller.
Figure 6:
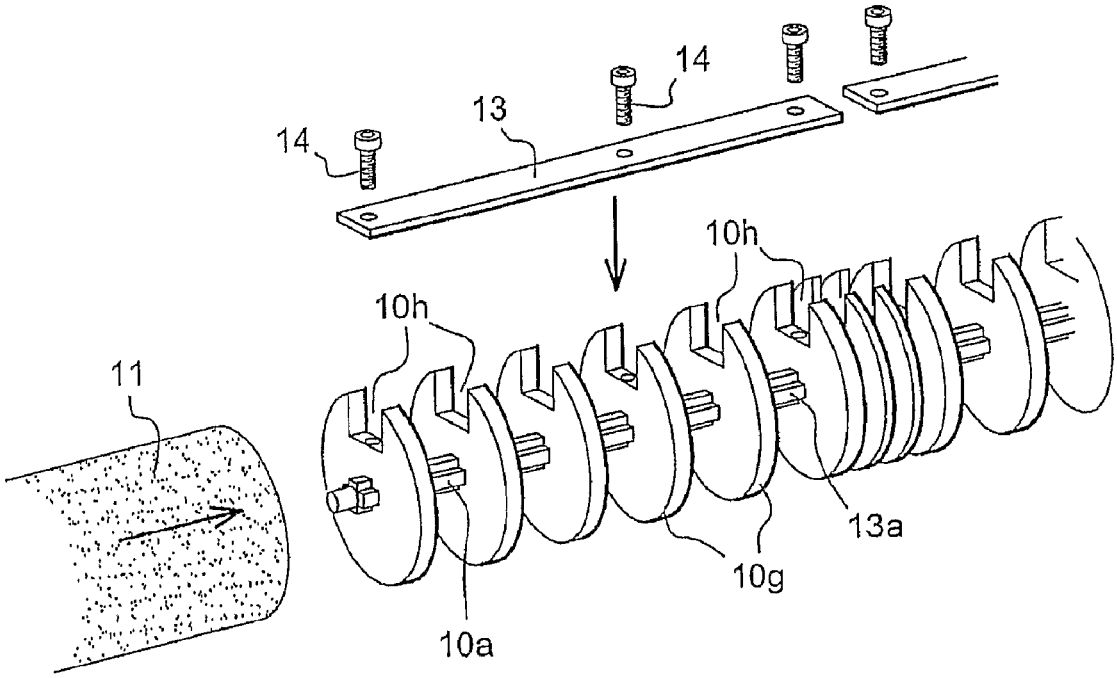
FIG. 6 shows an alternative view of the method of fixing by means of tensioning.

The means of tensioning (13) is thus in the form of a short horizontal bar (13*a*) for each sleeve or sleeve part, this flat short bar being inserted into the notches of the above-mentioned disc. The short bar is attached to the roller in two possible ways as shown, by way of example, in the drawing figures. In FIGS. 3, 4 and 5, the short bar (13*a*) has, at its ends, prongs (13*b*) with a shaped tip in the form of a hook (13*c*) that fit and attach in the matching shape or recess in the central core of the roller. In this example, the core is designed with catches which make it possible to clip fasten the short bar. This acts as a U-bolt and can be easily disassembled if needed. In the alternative shown in FIG. 6, the short bar (13*a*) is fixed by connecting screws (14) that penetrate through the sleeve into the bottom of the intermediate discs.

The fixing of the means of tensioning (13) the sleeves makes it possible to obtain maximum tension with improved hard contact with the web from the reel of material. The use of the means (13) also makes it possible to prevent any electrostatic charging due to contact with the web of material made of non-woven, base wad or similar paper.

The service life of the roller is therefore longer and there is no risk of the sleeves becoming detached because they are held in position by being clamped firmly by the short bars. If U-bolt shaped short bars are used, there is no risk of sleeves becoming loose because deliberate action by the operator is needed in order to release them only if there is a requirement to change the sleeves.

The number of U-bolt shaped short bars depends, for example, on the number of sleeves placed on the roller, depending on the latter's characteristics and how it is fitted into the wipe material dispensing machines.

Figure 7:
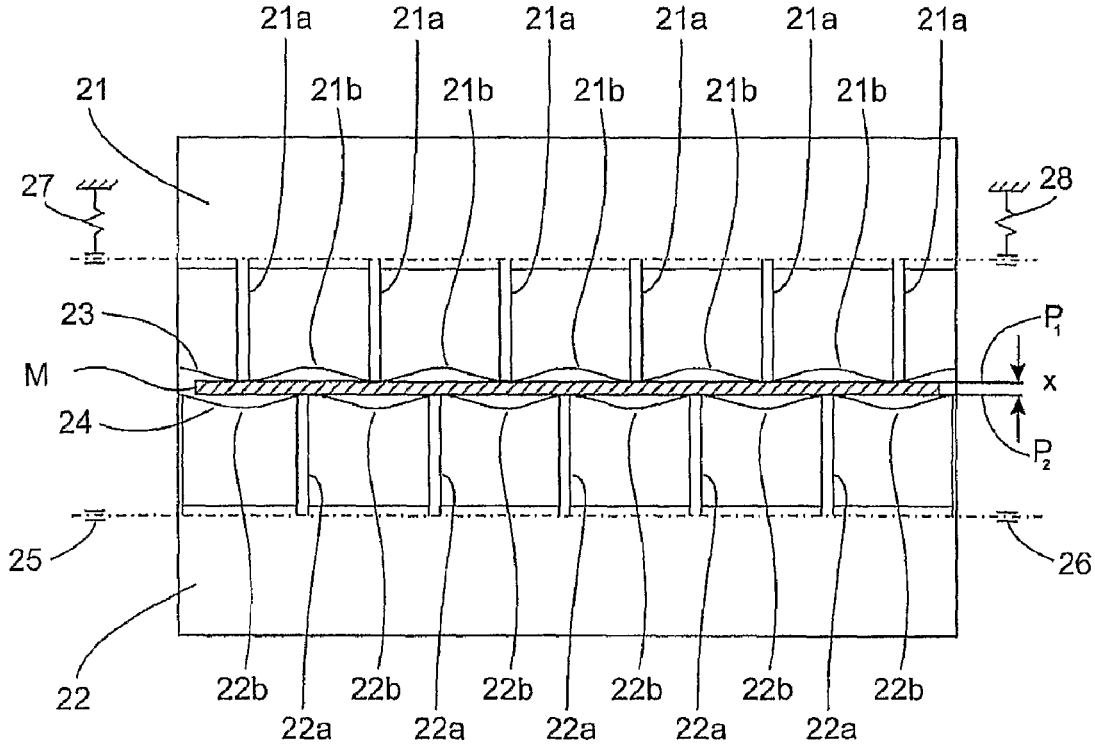
FIG. 7 shows a schematic cross-section through a roller assembly according to the invention.

FIG. 7 shows a schematic cross-section through a roller assembly 20 provided with a pair of rollers 22, 23 according to the invention. The roller assembly 20 comprises a first and a second roller 21, 22, wherein each roller comprises a central longitudinal core on which is mounted a number of parallel and axially spaced discs 21*a*, 22*a*, as described in connection with FIGS. 3 and 4 above. Each roller 21, 22 is provided with a single sleeve 23, 24 tensioned around the discs as described above. The rollers 21, 22 have regions 21*b*, 22*b* of reduced diameter between adjacent discs 21*a*, 22*a*, respectively. The first and the second roller are located so that the axial location of the spaced discs 21*a* on the first roller 21 coincides with the regions 22*b* of reduced diameter between adjacent discs 22*a* on the second roller 22.

In the example shown in FIG. 7, the outer surfaces of the first and second rollers 21, 22 are arranged spaced apart. The distance x between tangential planes P1, P2 through the outermost periphery of the first and second roller is equal to the thickness of the wipe material M to be passed between the rollers 21, 22.

In the roller assembly shown, the first roller 21 is a movable upper roll and the second roller 22 is a fixed lower roll, mounted in bearings 25, 26. The movable upper roll is suspended by a spring suspension 27, 28. The spacing between the rollers, represented by the distance x is adjustable to allow the roller assembly to be adjusted for different thicknesses and qualities of wipe material.

Figure 8:
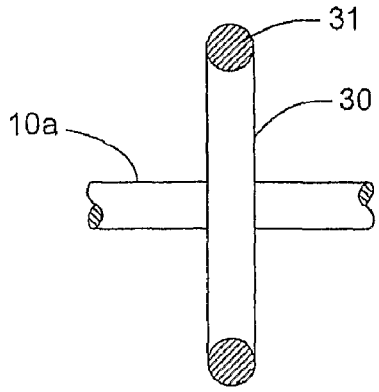
FIG. 8 shows a cross section through a disc according to an alternative embodiment of the invention.

FIG. 8 shows a cross section through a disc 30 according to an alternative embodiment of the invention. Instead of a sleeve of elastic material stretching over several discs, each disc 30 can be provided with an individual sleeve or ring 31 of material around the circumference of the disc. The disc 30 can be mounted on a central core 10*a*, as shown in FIG. 3.

The invention is not limited to the embodiments described above, but may be varied freely within the scope of the claims.

The invention claimed is:

1. Roller assembly in a wipe material dispenser having at least one pair of cooperating rollers arranged to feed wipe material comprising a first roller and a second roller, wherein each roller comprises a central longitudinal core on which is mounted a number of parallel and axially spaced discs, each roller has regions of reduced diameter between adjacent discs, and the first roller and the second roller are located so that an axial location of the spaced discs on the first roller coincides with the regions of reduced diameter between adjacent discs on the second roller at least one of the first and second rollers is provided with at least one sleeve of a friction material arranged around the discs and one tensioning means comprising an extended bar fitted into notches in the outer periphery of the discs for applying tension to said sleeve.

2. Roller assembly according to claim 1, wherein outer surfaces of the first roller and second rollers are arranged spaced apart.

3. Roller assembly according to claim 2, wherein a distance between tangential planes through an outermost periphery of the first roller and the second roller is configured to accommodate a thickness of the wipe material.

4. Roller assembly according to claim 2, wherein a spacing between the first rollers and the second roller is adjustable.

5. Roller assembly according to claim 1, wherein tangential planes through an outermost periphery of the first roller and the second roller are arranged to coincide or to intersect the discs of a respective cooperating roller.

6. Roller assembly according to claim 1, wherein the first roller comprises a fixed lower roller and the second roller comprises a movable upper roller.

7. Roller assembly according to claim 1, wherein the movable upper roller is suspended by a spring suspension.

8. A wipe material dispenser comprising a roller assembly according to claim 1.

9. A roller for a roller assembly for a wipe material dispenser wherein the roller comprises a central longitudinal core with a number of parallel and axially spaced discs, the roller is provided with as least one sleeve of a friction material arranged around the discs and one tensioning means comprising an extended bar fitted into notches in the outer periphery of the discs for applying tension to said sleeve, and the roller has regions of reduced diameter between adjacent discs.

10. A roller according to claim 9, wherein the sleeve of friction material is made of an outer periphery of elastically deformable material.

11. A roller according to claim 9, wherein an outer periphery of each individual disc is covered by a sleeve.

12. A roller according to claim 9, wherein the roller is covered by an elastically deformable material along an entire width of the roller.

13. A roller according to claim 9, wherein the roller is provided with two elastically deformable sleeves separated along a width of the roller.

14. A roller according to claim 13, wherein the sleeves are separated by a central spacing for a drive belt.

15. A roller according to claim 9, wherein the roller is provided with at least one tensioning means for each sleeve.

16. A roller according to claim 9, wherein a cutting device is mounted in the notches.

17. A roller according to claim 9, the discs are located intermediated and parallel to end discs mounted at each end of the roller.

18. A roller according to claim 17, wherein the roller is a cutting roller, wherein one end disc and the intermediate discs are provided with a notch in which a cutting device is mounted.

19. A roller according to claim 18, wherein a first end of the roller is provided with an end disc with an opening for an actuator arranged to act on a first end of a blade-holder.

20. A roller according to claim 19, wherein a second, opposite end of the roller is provided with a notched end disc with a support for a second end of the blade holder.

21. A roller according to claim 9, wherein the discs are separated by a predetermined, constant distance.

22. A roller according to claim 9, wherein the discs are separated by a distance that varies across a width of the roller.

23. A roller according to claim 9, wherein at least one sleeve is made of a thermoplastic elastomer material.

* * * * *